US010940537B2

(12) United States Patent
King et al.

(10) Patent No.: US 10,940,537 B2
(45) Date of Patent: Mar. 9, 2021

(54) PROCESS FOR PRODUCING A PREFORM USING COLD SPRAY

(71) Applicant: Commonwealth Scientific and Industrial Research Organisation, Acton (AU)

(72) Inventors: Peter Christopher King, Victoria (AU); Stefan Gulizia, Victoria (AU); Andrew Joseph Urban, Victoria (AU); John Edward Barnes, Victoria (AU)

(73) Assignee: COMMONWEALTH SCIENTIFIC AND INDUSTRIAL RESEARCH ORGANISATION, Act (AU)

( * ) Notice: Subject to any disclaimer, the term of this patent is extended or adjusted under 35 U.S.C. 154(b) by 522 days.

(21) Appl. No.: 15/303,857

(22) PCT Filed: Apr. 13, 2015

(86) PCT No.: PCT/AU2015/050168
§ 371 (c)(1),
(2) Date: Oct. 13, 2016

(87) PCT Pub. No.: WO2015/157816
PCT Pub. Date: Oct. 22, 2015

(65) Prior Publication Data

US 2017/0157671 A1 Jun. 8, 2017

(30) Foreign Application Priority Data

Apr. 15, 2014 (AU) ..... 2014901373

(51) Int. Cl.
*B22F 3/115* (2006.01)
*B05B 13/04* (2006.01)
(Continued)

(52) U.S. Cl.
CPC ..... *B22F 3/115* (2013.01); *B05B 7/14* (2013.01); *B05B 7/1486* (2013.01);
(Continued)

(58) Field of Classification Search
CPC ..... B05B 13/041; B22F 3/115
See application file for complete search history.

(56) References Cited

U.S. PATENT DOCUMENTS 4,224,356 A * 9/1980 Singer ..... B22D 23/003 164/46
4,938,275 A * 7/1990 Leatham ..... B22D 23/003 118/320
(Continued)

FOREIGN PATENT DOCUMENTS

CN 102294478 12/2011
CN 202849544 4/2013
(Continued)

OTHER PUBLICATIONS

International Search Report and Written Opinion dated Jul. 8, 2015 issued in PCT/AU2015/050168.
(Continued)

*Primary Examiner* — Anthony J Zimmer
*Assistant Examiner* — Jeremy C Jones
(74) *Attorney, Agent, or Firm* — Kilpatrick Townsend & Stockton LLP

(57) ABSTRACT

A process for producing a preform by cold spray deposition, the process comprising: providing a starter substrate about a preform axis of rotation, the starter substrate having at least one axial end having a substantially flat deposition surface; rotating the starter substrate about the preform axis of rotation; depositing material onto the deposition surface of the starter substrate using cold spray deposition to form a product deposition surface, the cold spray deposition pro-
(Continued)

cess including a cold spray applicator through which the material is sprayed onto the deposition surface; successively depositing material onto a respective top product deposition surface using cold spray deposition to form successive deposition layers of the material; and moving at least one of: the cold spray applicator; or the starter substrate and preform product, relative to the other in an axial direction along the preform axis of rotation to maintain a constant distance between the cold spray applicator and the top product deposition surface, thereby forming a preform product of a selected length, wherein the cold spray applicator is moved in a plane perpendicular to the preform axis of rotation so as to deposit material as a substantially flat surface on each respective deposition surface of the starter substrate or product deposition surface of the preform product.

18 Claims, 4 Drawing Sheets

(51) Int. Cl.
*B05B 7/14* (2006.01)
*C23C 24/04* (2006.01)

(52) U.S. Cl.
CPC ..... *B05B 13/041* (2013.01); *B05B 13/0431* (2013.01); *B05B 13/0442* (2013.01); *C23C 24/04* (2013.01)

(56) References Cited

U.S. PATENT DOCUMENTS

| | | | | |
|---|---|---|---|---|
| 9,610,605 | B2 * | 4/2017 | Jensen | C22C 32/0094 |
| 2001/0050041 | A1 * | 12/2001 | Reardon | H01L 21/67075 118/52 |
| 2005/0100756 | A1 | 5/2005 | Riley et al. | |
| 2008/0241570 | A1 | 10/2008 | Zhang et al. | |
| 2009/0301328 | A1 | 12/2009 | Zahiri et al. | |
| 2010/0201228 | A1 | 8/2010 | Friend et al. | |
| 2011/0078896 | A1 | 4/2011 | Calla et al. | |

FOREIGN PATENT DOCUMENTS

| | | |
|---|---|---|
| JP | 2009-13472 | 1/2009 |
| JP | 2013142176 | 7/2013 |
| RU | 2075535 | 3/1997 |
| WO | 2013/149291 | 10/2013 |

OTHER PUBLICATIONS

Krishna et al., "Use of powder metallurgy preforms as alternative to produce bimettalic tubes", Materials Science and Technology, Jun. 2005 (11 pgs).

* cited by examiner

PROCESS FOR PRODUCING A PREFORM USING COLD SPRAY

CROSS REFERENCE TO RELATED APPLICATIONS

This application is a U.S. National Stage of International Application No. PCT/AU2015/050168, filed Apr. 13, 2015, which claims the benefit of Australian patent Application No. 2014901373, filed Apr. 15, 2014, the entire contents of which are incorporated herein by reference.

TECHNICAL FIELD

The present invention generally relates to a process for producing a preform using cold spray deposition technology. The invention is particularly applicable for producing preforms having a round cross-section, and more particularly round titanium or titanium alloy preforms and it will be convenient to hereinafter disclose the invention in relation to that exemplary application. However, it should be appreciated that the invention should not be limited to the application, and can be used to produce preforms of a number of materials, and in particular metallic materials including copper, aluminium, ferrous alloys, ceramics, metal matrix composites or the like.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Titanium and its alloys have a high oxygen affinity and are therefore expensive to produce as processes such as vacuum arc and cold hearth melting are required which use controlled atmospheres. One alternate method of directly manufacturing titanium parts or products is through the use of cold spray technology. In cold spray processes, small particles in the solid state are accelerated to high velocities (normally above 500 m/s) in a supersonic gas jet and deposited on a substrate material. The kinetic energy of the particles is utilised to achieve bonding through plastic deformation upon impact with the substrate. The absence of oxidation enables cold spray technology to be used for near net shape manufacturing of shaped titanium products from a powder.

In one particular application, cold spray technology has been used to produce seamless hollow pipes. International Patent Publication WO2009109016A1 describes one such process in which a seamless pipe is produced using cold-gas dynamic spraying of particles onto a starter substrate comprising a mandrel and a mold, where the external surface of the mandrel defines the internal surface of the pipe and the internal surface of the mold defines the external surface of the pipe. The pipe is subsequently separated from the starter substrate. This process is improved in International Patent Publication WO2011017752A1 through the use of a movable starter substrate that can be moved longitudinally relative to the formed pipe to progressively remove the formed pipe from the starter substrate. This improvement enables the formation of a seamless titanium or titanium alloy pipe of a desired length.

Whilst useful to form hollow products, these pipe forming processes cannot be used to form a solid shape such as a rod or bar consisting solely of spray deposited material because each pipe forming method relies on the use of a starter substrate to support and shape the formed product.

Solid spray deposit components can be formed through progressive deposition of layers in a desired spray pattern. However, solid shapes formed using conventional cold spray methods can have difficulties resulting from heating requirements of the accelerating gas to achieve high velocities and to allow some thermal softening of the particles. For example, cold spray of titanium alloys with low porosity typically requires preheating in the range 700 to 1100° C. This inevitably results in considerable heat transfer to the deposit every time the gas jet moves past. Heating produces thermal stresses which cause cracking in large deposits, or separation of the deposit from the substrate, even while cold spray is still in progress. Oxidation may even occur if the surface temperature is high enough.

In order to mitigate this problem, the cold spray nozzle is normally scanned across the surface quickly to allow the heat at any one location to dissipate before the next nozzle pass. For example, large deposits of material, such as square section bars or billets, can be produced by cold spray using a raster spray method in which a large cold spray gun is moved at 0.5 m/s or greater over a stationary deposition surface in a tight raster pattern with 180° turns at the end of each pass. In addition to the high velocity required by a robot arm to move the gun, a raster spray method also places considerable strain on a robot arm moving a cold spray gun and causes vibrations in the spray gun and hoses which affect the uniformity of the deposit. Furthermore, there may be feed fluctuations from the powder feeder. Disturbances in the supersonic jet due to it repeatedly moving on and off the deposit surface further exacerbate this effect. If the thickness of the deposit is only a few millimetres or less these surface irregularities are small and are often simply ignored. However, as the deposit grows the irregularities tend to become more and more exaggerated. Particle impact onto slopes reduces the normal component of impact velocity, and flow of the gas jet is restricted in deep ridges or depressions. As a result, the surface has to be machined flat at intervals, which wastes material and time.

It would therefore be desirable to provide an alternate method of producing a preform using cold spray technology.

SUMMARY OF THE INVENTION

The present invention provides a process for producing a preform by cold spray deposition, the process comprising:

providing a starter substrate about a preform axis of rotation, the starter substrate having at least one axial end having a substantially flat deposition surface;

rotating the starter substrate about the preform axis of rotation;

depositing material onto the deposition surface of the starter substrate using cold spray deposition to form a product deposition surface, the cold spray deposition process including a cold spray applicator through which the material is sprayed onto the deposition surface;

successively depositing material onto a respective top product deposition surface using cold spray deposition to form successive deposition layers of the material; and moving at least one of: the cold spray applicator; or the starter substrate and preform product, relative to the other in an axial direction along the preform axis of rotation to maintain a constant distance between the cold spray applicator and the top product deposition surface, thereby forming a preform product of a selected length, wherein the cold spray applicator is moved in a plane perpendicular to the preform axis of rotation so as to deposit material as a substantially flat surface on each respective deposition surface of the starter substrate or product deposition surface of the preform product.

The process of the present invention enables the formation of a preform product of titanium, titanium alloy or other material of a desired length through the axial movement of the preform after each layer is formed. The present invention addresses the issues of prior art cold spray deposition methods by employing a combination of movements: the workpiece is rotated about a preform axis of rotation while movement of the cold spray nozzle has a controlled movement in a plane perpendicular to the preform axis of rotation. The rotation ensures that the relative movement between nozzle and workpiece is fast, while the robot or other device controlling and moving the nozzle and gun is not required to achieve high velocities or perform fast turns.

Furthermore, the preform product of the present invention advantageously retains a substantially uniform microstructure throughout, without macrosegregation and other melt-related defects found in ingots because the constituting powder particles are not melted in the cold spray process.

The present invention produces a preform product about a preform axis of rotation. The preform is therefore typically formed as a round preform. It is to be understood that the term "round preform" is used here to mean a shape which is solid, and has curved or round cross-sectional shape about its central longitudinal axis. The round cross-sectional shape can comprise any round shape, including circular, oval or the like. In some embodiments, the round cross-sectional shape has rotational symmetry about its central longitudinal axis. In other embodiments, the round cross-sectional shape is asymmetric about its central longitudinal axis, for example an oval or the like.

A preform formed from the process of the present invention can therefore comprise (but should not be limited to) at least one of a disc, rod, pole, staff, wand, cylinder, column, mast, shaft, dowel or the like. In some embodiments, the preform comprises a bar, which is understood to have a length greater than its diameter, for example at least twice its diameter. Considerably large diameters preforms may be produced by the invention, limited only by the size of apparatus available. In other embodiments, the preform is hollow or includes one or more voids.

In some embodiments, the preform has a constant diameter along the length of the preform. In other embodiments, the preform is formed with variable or non-constant diameter along the length of the preform. Preforms with a non-constant diameter include cone shapes, cone section, shapes with a step or taper (large diameter to smaller diameter) or the like. In one embodiment, the diameter changes in a constant manner throughout or along the length of the preform.

It should also be understood that the term "top product deposition surface" is the deposition surface of the outer or newest deposition layer of the preform product, axially closest to the cold spray applicator.

The cold spray applicator is moved in a plane perpendicular to the preform axis of rotation so as to deposit material as a substantially flat surface on each respective deposition surface of the starter substrate or product deposition surface of the preform product. The plane is defined by two axes (X and Y) each of which are perpendicular to the preform axis of rotation, the deposition movement of the cold spray applicator moving relative to those axes in that plane when spraying material to form the product preform. As described below, that movement may be linear, trace a polygon shape or other path within that plane in order to deposit each respective layer of material on each respective deposition surface of the starter substrate or product deposition surface of the preform product.

As noted above, it is important to maintain a substantially flat deposition surface to mitigate, and more preferably substantially avoid the formation of defects or other irregularities in the deposited material and thus microstructure thereof. A substantially flat deposition surface typically comprises a planar surface preferably orientated perpendicular to the preform axis of rotation. The flat surface of deposit material is therefore preferably maintained through controlled movement of cold spray applicator.

In some embodiments, this can be achieved through control of the movement of the cold spray applicator so that the instantaneous velocity of the cold spray applicator relative to the deposit surface is inversely proportional to radial distance the cold spray applicator is to the preform axis of rotation. Preferably, the speed of rotation of the starter substrate and attached product preform is substantially constant.

It should be noted that the speed of rotation of the starter substrate and attached product preform can also be controlled and varied to vary the relative velocity of the cold spray applicator and deposition surface. Again, the instantaneous velocity of the cold spray applicator relative to the deposit surface can be controlled to be inversely proportional to radial distance the cold spray applicator is to the preform axis of rotation and in this embodiment also account for changes in the speed of rotation of the starter substrate and attached product preform.

In some embodiments, the cold spray applicator could be controlled at a constant speed and the rotational speed of the starter substrate and product preform (when formed) about the preform axis of rotation X-X could be controlled as a function of the of the cold spray applicator from the preform axis of rotation. As can be appreciated, this also varies the instantaneous velocity between the cold spray applicator and deposition surface.

The deposition pattern and related movement of the spray applicator can also influence the morphology of the deposited layers of material. The deposition pattern and related movement of the spray applicator is therefore also preferably controlled. In some embodiments, the controlled movement comprises a linear cyclical motion between at least two points. For example, the controlled movement can comprise a linear cyclical motion between two points, point A and point B.

In a first spray method (spray method 1), point A is at an edge of the deposition surface of the preform product, and point B is close to, or at the centre of the respective deposition surface. Thus in spray method 1, the nozzle is moved linearly back-and-forth in a plane perpendicular to the preform axis of rotation between point A and point B. The nozzle velocity is higher near point B, relative to the nozzle velocity near point A.

In a second spray method (spray method 2), point A and point B are at or adjacent an edge of the respective deposition surface, preferably located on opposite sides of the deposition surface. In spray method 2, the nozzle is moved linearly back-and-forth in a plane perpendicular to the preform axis of rotation between point A and point B at the edge of preform. While moving from point A towards point B or from point B towards point A the nozzle velocity initially increases, reaching a maximum at the point closest to the axis of preform rotation (point C, which is equidistant from point A and point B), and then decreases.

As can be appreciated, the inverse proportional relationship of spray applicator velocity to radial distance to the preform axis of rotation would theoretically require the spray applicator to move at an infinite velocity at the center of the preform (the preform axis of rotation). Thus, in some embodiments, movement of the spray applicator is configured to have a radial offset from a parallel path running through the preform axis of rotation. The offset is typically a small distance, for example from 0.1 to 15 mm, and preferably from 0.5 to 10 mm. The small offset still allows particles at the edge of the spray beam to 'fill in' the central part of the preform. This is possible because spray beams generally exhibit some degree of divergence which principally depends on the nozzle design. For example, a spray applicator having a nozzle with circular cross-section produces a circular spot pattern on the substrate surface.

In a further spray method (spray method 3), the controlled movement comprises a linear cyclical motion between four points, points A, B, C and D. In preferred embodiments, points A, B, C and D define the vertices of a regular polygon, preferably a square or rectangle, and the controlled movement comprises linear movement in a plane perpendicular to the preform axis of rotation which traces the polygon shape between the respective points. In some embodiments, the regular polygon comprises a rectangle having a height of from 0.1 to 15 mm, and preferably from 0.5 to 10 mm.

Thus four points, points A, B, C and D, are used in spray method 3, and the nozzle traces a rectangular or square path around those points. Preferably, point A and B are on opposite edges of the respective deposition surface/preform to point C and D. In some embodiments, there is a small distance, for example 0.5 to 10 mm, separating point A from point B, and an equally small distance separating Point C from point D. In moving from point A to point B, and likewise from point C to point D the instantaneous velocity of the cold spray applicator relative to the deposit surface can be controlled to be inversely proportional to radial distance the cold spray applicator is to the preform axis of rotation. In moving from point B to point C and in moving from point D to point A, a relatively fast nozzle movement is preferably used.

In yet another embodiment, the cold spray applicator is moved in a spiral pattern relative to the deposit surface.

It should be understood that using these and other spray patterns, a circular cross-section can be made using the process of the present invention through rotation of the starter substrate and formed preform product and corresponding movement the cold spray applicator with respect to the respective deposition surfaces. It should be appreciated, that an asymmetrical round shape such as an oval shape could be produced by synchronising the rotational movement of the starter substrate and formed preform product with the lateral movement of the cold spray applicator.

Movement of the cold spray applicator can be by any suitable means. In one embodiment, movement of the cold spray applicator is controlled by a multi-axis robot arm. In another embodiment, movement of the cold spray applicator is controlled by a linear actuator.

Cold spray equipment typically include a cold spray applicator in the form of a cold spray gun having a nozzle. The nozzle typically includes an exit opening through which deposit material is sprayed, the nozzle directing the sprayed deposit material in a desired direction. In use, the nozzle is preferably aligned substantially to or parallel to the axis of preform rotation during movement. However, in some embodiments the nozzle can be directed to an angle, towards the centre of the axis of preform rotation when at or near an outer edge of the deposition surface. The nozzle is preferably moved to this angle when movement of the nozzle approaches the outer edge of the deposition surface (corresponding to the edge of the preform product). In this embodiment, the cold spray nozzle is turned so that it is angled inwardly, towards the centre of the preform, each time the nozzle approaches the edge of the preform. This technique can be used to control the growth of the edges of the preform so that the preform maintains a constant diameter.

The starter substrate is used as an initiation or starter surface for formation of the preform product. The starter substrate may comprise at least one of:

a substrate with matching material properties; or a substrate made of dissimilar material.

As can be appreciated, it is preferred that the material of the starter substrate is a material on which the deposited material will adhere. Accordingly, a material with matching properties, and more preferably the same or substantially similar material is preferred as the deposited cold spray material will bond with such material. In some embodiments, the starter substrate is made by a cold spray method. In some embodiments, the starter substrate comprises a starter preform, and more preferably comprises a preform formed using a process of the present invention.

The starter substrate can have any suitable dimensions. In some embodiments, the starter substrate has at least the same diameter as the preform product, preferably a greater diameter that the preform product.

It can be desirable to separate the starter preform from the preform product once the preform product is formed, particularly where the starter preform does not have the same material composition as the preform product. The process of the present invention can therefore further comprise the step of: removing the preform product from the starter substrate. This typically occurs at or after the conclusion of the cold spray deposition process forming the preform. Separation of the preform product from the starter substrate may be achieved by any suitable means, including mechanical such as cutting, cleaving, breaking, fracturing, shearing, breaking or the like, or by other means including dissolving, melting, evaporating or the like of the starter substrate.

The axial end surface of the starter substrate to be coated with particles will influence the characteristics of the corresponding surface of the preform to be produced. Desirably, the axial end surface of the starter substrate to be coated is smooth and defect-free. When the axial end surface of the starter substrate to be coated is smooth and free of defects (e.g., scratches, dents, pits, voids, pinholes, inclusions, markings etc.) the preform produced should also be smooth and defect-free. As noted above, the axial end surface of the starter substrate is preferably substantially flat (substantially planar). In some embodiments, the axial end surface of the starter substrate comprises a radially flat surface relative to the preform axis of rotation The deposited material may comprise any suitable material, preferably any suitable metal or alloy thereof. In some embodiments, the material comprises at least one of titanium, copper, aluminium, iron or an alloy thereof. One particular metal alloy of interest is alloy Ti-6Al-4V. This material is preferably produced as a preform using the process of the present invention. The preform product preferably has at least 80% density, preferably at least 90% density, and more preferably at least 95% density as produced. It should be appreciated that the density of the preform as produced is in part material dependent. In some embodiments, the material comprises a ceramic or glass. In other embodiments, preforms composed of a composite of at least two different metals, or of a mixture of at least one metal and at least one ceramic could be made. For example a blend of two or more different powders, or composite particles (particles consisting of more than one material) could be used as feedstock.

In some embodiments, the composition that is applied by cold spraying may be varied along the length of the preform to be produced. This may provide flexibility in terms of product characteristics. For example, a metallic preform such as a bar or rod that has different weld characteristics at opposing axial ends may be produced by varying the composition as between the different ends. Alternatively, if a variation in the preform properties (for example, coefficient of thermal expansion) is desired along the length of the preform, then the preform composition may be varied accordingly. Thus, the preform may comprise discrete lengths of different materials or the composition of the preform may be varied gradually along the length of the preform or the preform may comprise a combination of these arrangements.

If a preform is to be manufactured from multiple materials, then the compatibility of the different materials must be considered. Should two or more of the proposed materials be incompatible in some way (for example coherence/bonding), it may be necessary to separate the incompatible materials by one or more regions of mutually compatible material(s). Alternatively, the preform could be manufactured such that there is a gradual change in composition from one material to the next to ease any incompatibility problems between the materials used.

Any suitable particle/powder can be used with process of the present invention. The powder/particles used, and properties thereof will typically be selected to meet the desired properties, composition and/or economics for a particular preform product. Typically the size of the particles applied by cold spraying is from 5 to 45 microns with an average particle size of 15 to 30 microns. However, it should be appreciated that the particle size may vary depending on the source and specification of the powder used. Similarly, larger particles could also be used in some applications, for example particle sizes up to around 150 microns. A person skilled in the art will be able to determine the optimum particle size or particle size distribution to use based on the morphology of the powder and characteristics of the preform that is to be formed. Particles suitable for use in the present invention are commercially available.

It should be appreciated that the average size of the particles that are cold sprayed is likely to influence the density of the resultant layer deposition of material, and thus the density of the preform that is formed. Preferably the deposition is of uniform density and free from defects, connected micro-voids (leakage) and the like, since the presence of such can be detrimental to the quality of the resultant preform. In some embodiments, the billet includes pores which are generally on the same scale as the sprayed particles. The pores are preferably of uniform concentration throughout the preform.

An apparatus used for implementation of a method of the present invention is likely to be of conventional form and such equipment is commercially available or individually built. In general terms, the basis of the equipment used for cold spraying is described and illustrated in U.S. Pat. No. 5,302,414 the contents of which should be understood to be incorporated into this specification by this reference. A number of commercially available cold spray equipment is available. It should be appreciated that the present invention is not limited to one or a certain type of cold spray system or equipment, and can be implemented using a wide variety of cold spray systems and equipment.

The cold spray applicator and comprising cold spray apparatus can include a number of elements. In some embodiments, the starter substrate is held about the preform axis of rotation using a mounting arrangement which includes clamp chuck, or the like, for example a feed-through chuck. The mounting arrangement also preferably includes at least one rest, bearings or roller onto which the starter substrate and/or product preform can engage or be otherwise supported during operation. The mounting arrangement can also be operatively connected to a driven arm about the preform axis of rotation which drives rotation of at least part of the mounting arrangement holding the starter substrate about the preform axis of rotation. In some embodiments, the mounting arrangement is also operatively connected to a driven arm which actuates movement of at least part of the mounting arrangement holding the starter substrate in an axial direction along the preform axis of rotation. For example, the starter substrate can be locked in place using a chuck or other standard clamping device and a lathe may be used to rotate the chuck with a deposition moved radially relative to the axis of the rotation of the chuck on the end face of the starter substrate. In this case, rotation of the chuck combined with radial movement of the nozzle is responsible for build up of a deposition on the axial end face of the starter substrate in order to produce a preform. Multiple nozzles may be used in tandem for cold spraying preforms of considerable length and/or diameter. The use of multiple nozzles may also speed up the manufacturing process.

The operating parameters for the cold spraying process may be manipulated in order to achieve a preform that has desirable characteristics (density, surface finish etc). Thus, parameters such as temperature, pressure, stand off (the distance between the cold spraying nozzle and the starter substrate surface to be coated), powder feed rate and relative movement of the starter substrate and the cold spraying nozzle, may be adjusted as necessary. Generally, the smaller the particle size and distribution, the denser the layer formed on the surface of the starter substrate. It may be appropriate to adapt the cold spraying equipment used in order to allow for higher pressures and higher temperatures to be used in order to achieve higher particle velocity and more dense microstructures, or to allow for pre-heating the particles.

The process of the present invention enables the direct conversion of titanium powder into a metallic body in the form of a round rod or preform. With the advent of cheap titanium powders the process of the present invention may therefore provide an economically attractive option for producing primary mill products such a billets, in this case in the form of a preform such as a disk, bar or rod.

The present invention also provides a practical method for producing fine grain, preferably ultrafine grained material on a large scale. In this regard, the microstructure of the sprayed particles is substantially retained and/or refined through the cold spray process. Thus, the preform can include a microstructure containing fine to ultrafine grains. Such a microstructure is desirable in a preform material as it imparts desirable properties to that preform.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

The present invention provides a process for forming a preform such as a disk, bar, rod, cone or the like of material using cold spray technology.

Cold spraying is a known process that has been used for applying coatings to surfaces. In general terms, the process involves feeding (metallic and/or non-metallic) particles into a high pressure gas flow stream which is then passed through a converging/diverging nozzle that causes the gas stream to be accelerated to supersonic velocities, or feeding particles into a supersonic gas stream after the nozzle throat. The particles are then directed to a surface to be deposited. The process is carried out at relatively low temperatures, below the melting point of the substrate and the particles to be deposited, with a coating being formed as a result of particle impingement on the substrate surface. The process takes place at relatively low temperature thereby allowing thermodynamic, thermal and/or chemical effects, on the surface being coated and the particles making up the coating, to be reduced or avoided. This means that the original structure and properties of the particles can be preserved without phase transformations or the like that might otherwise be associated with high temperature coating processes such as plasma, HVOF, arc, gas-flame spraying or other thermal spraying processes. The underlying principles, apparatus and methodology of cold spraying are described, for example, in U.S. Pat. No. 5,302,414 the contents of which should be understood to be incorporated into this specification by this reference.

In the present invention, cold spray technology is used to build up a preform structure on the axial end surface of a starter substrate. The starter substrate can then be removed to produce a primary preform product.

Figure 1:
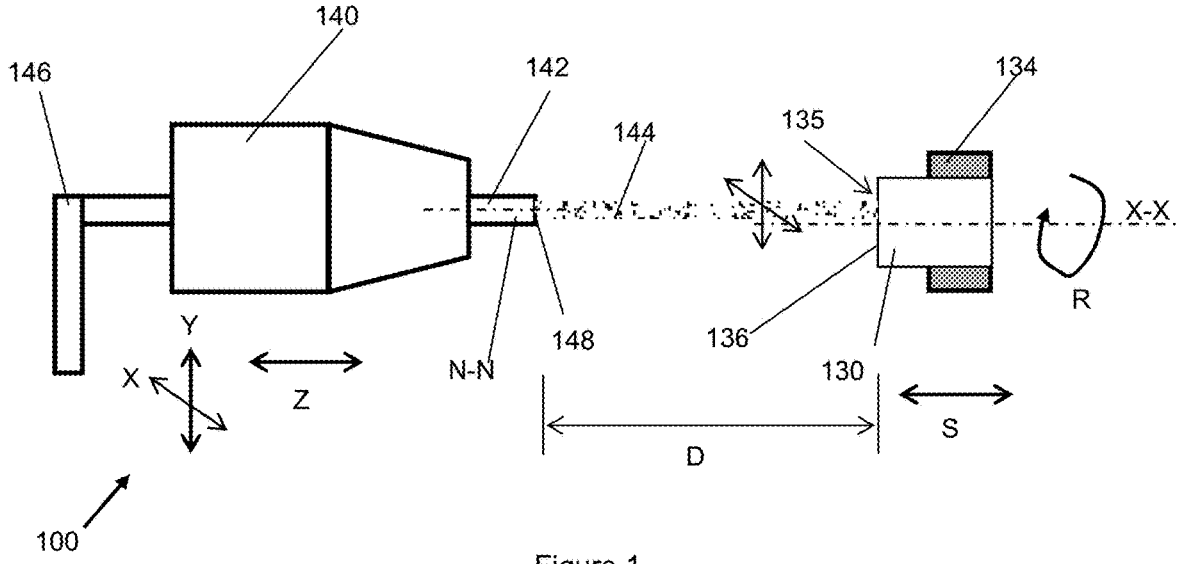
FIG. 1 is a schematic diagram of one embodiment of the cold spray process of the present invention at start up.

FIG. 1 illustrates the basic schematic of one apparatus 100 for forming a preform according to the present invention. In this embodiment an initiating substrate, in the form of a starter substrate 130 is initially used to provide a surface on to which the product preform 132 (FIG. 2) is sprayed. The illustrated starter substrate 130 is a round bar having an outer diameter which is about the same as the desired outer diameter of the preform 132 being produced. However, it should be appreciated that the starter substrate could be of any suitable shape, configuration or diameter, and in particular of a diameter which is at least the same as the diameter of the preform product 132 being produced. The starter substrate 130 includes an axial deposition end 135 having a substantially flat deposition surface 136 on which the cold spray material is deposited during operation.

The starter substrate 130 is mounted and held about a preform axis of rotation X-X within the apparatus 100 using a mounting arrangement 134. Whilst not shown in detail in FIG. 1 or 2, this mounting arrangement 134 could be any suitable clamp or chuck type arrangement, a number of which are currently commercially available. In exemplary embodiments, the starter substrate 130 is held about the preform axis of rotation X-X chuck, preferably a feed-through chuck. Whilst not illustrated, the mounting arrangement 134 can also include one or more rests, bearings or rollers on which the starter substrate 130 and/or product preform 132 can engage, bear or otherwise be supported during operation of the apparatus 100.

At least part of the mounting arrangement 134 is operatively driven about the preform axis of rotation X-X which in turn drives rotation of the starter substrate 130 about the axis X-X in the direction of arrow R. A number of suitable rotation arrangements are possible, including but not limited to drive wheels, turntables, lathe arrangements or the like. In one embodiment, the starter substrate 130 can be locked in place using a chuck attached to a lathe and the lathe used to rotate the chuck.

Once the starter substrate 130 is mounted in the mounting arrangement, the starter substrate 130 is rotated about the preform axis of rotation X-X. A cold spray applicator, in this case cold spray gun 140, is used to spray a desired material onto the deposition surface 136 of the starter substrate 130. As can be appreciated, the cold spray gun 140 includes a nozzle 142 through which material is sprayed and directed in a spray stream 144 onto the deposition surface 136. The cold spray gun 140 supplies a source of inert carrier gas and material feed particles to nozzle 142. The cold spray gun 140 and attached nozzle 142 is likely to be of conventional form and, in general terms, the basis of the equipment is as described and illustrated in U.S. Pat. No. 5,302,414. The material particles are entrained in the carrier gas and the carrier gas and particles are accelerated to supersonic velocities. Accordingly, the spray 144 exiting the nozzle 142 comprises a jet of carrier gas and entrained material particles.

The cold spray gun 140 and associated cold spray system may be operated using any of the gases that are common with this process, for example nitrogen or air. Helium is sometimes used because it provides greater particle acceleration. For example, acceptable results can be obtained with titanium and its alloys using nitrogen. However, if possible reaction with the particles is a concern, then argon may be a useful alternative.

The cold spray gun 140 is controlled to move about a three dimensional axis (each of the X, Y and Z axis) by robotic arm 146. However, it should be appreciated that the cold spray gun 140 could be moved by any suitable means, including a linear actuator or other means. Prior to spray application, the end 148 of the nozzle 142 is brought to a suitable deposition distance D from the deposition surface 136. This deposition distance is preferably 10 to 50 mm, more preferably 20 to 30 mm (depending on the cold spray gun 140) in order to provide a desired deposition pattern on the deposition surface 136.

Figure 2:
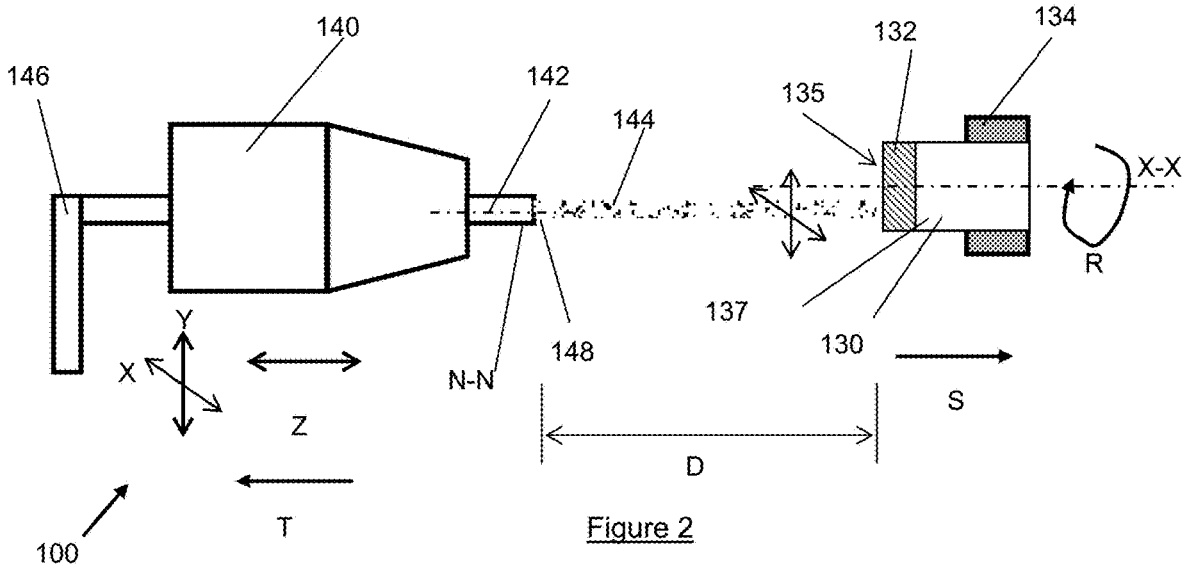
FIG. 2 is a schematic diagram of one embodiment of the cold spray process shown in FIG. 1 with a preform product deposited onto a starter substrate.

Spraying of materials particles from a nozzle 142 is commenced when the nozzle 142 is positioned the required deposition distance D from the deposition surface 136. The robotic arm 146 is used to move the cold spray gun 140 and nozzle 142 radially (about the X and Y axes shown in FIGS. 1 and 2) relative to the preform axis of the rotation X-X to cold spray material onto the deposition surface 136 of the starter substrate 130. In this case, rotation of the starter substrate 130 combined with radial movement of the nozzle 142 is responsible for build up of a deposition on the deposition surface 136 of the starter substrate 130. As shown in FIG. 2, a number of spray patterns can be used to form each deposition layer 137 of material forming the product preform 132. An example of some suitable spray patterns is described in more detail below.

The cold spray gun 140 and nozzle 142 are used to spray a first deposition layer on the deposition surface 136 of the starter substrate 130. The particles sprayed on the deposition surface 136 bond onto a portion of the deposition surface 136. The position of the starter substrate 130 is moved relative to the nozzle 144 along the preform axis of rotation X-X by either moving the starter substrate along the axis X-X or the nozzle 142 or both, in order to maintain a constant distance D between the end of the nozzle 148 and the top spray layer 137 of the axial deposition end 135. The spray gun 140 is then operated to deposit another layer of material onto the top spray layer 137 of material on the axial deposition end 135 thus extending the length of the product preform 132.

In some embodiments, the starter substrate 130 and product preform 132 is fed slowly through a feed-through chuck, in the lengthwise direction along axis X-X, away from the cold spray nozzle 142 so that as the preform grows a constant distance is maintained between the nozzle end 148 and the flat surface of the preform (deposition surface 136). In other embodiments, the spray gun 140 and nozzle 142 are moved in the lengthwise direction along axis X-X, away from the axial deposition end 135 of the product preform 132 and starter substrate 130. In yet other embodiments, a combination of the above two movements is used.

The movement of the preform 132 in the direction of arrow S (FIG. 2) and/or the spray gun 140 in the direction of arrow T (FIG. 2) is performed continuously at a slow rate that is equivalent to the rate of particles required to build up each layer of the product preform 132. In this manner, the product preform 132 is formed continuously and can be formed in any desired length.

The freshly deposited material should constantly maintain a substantially flat surface during each cold spray deposition on the top layer 137 of material on axial deposition end 135 in order that the product preform 132 grows at a constant rate over the entire cross-sectional area. This flat surface is maintained using the spray patterns and method described below.

When the desired length of formed preform 132 is reached, the starter substrate 130 is removed from the remainder of the formed preform 132. Separation of the preform 132 from the starter substrate 130 may be achieved by any suitable means, including mechanical such as cutting, cleaving, breaking, fracturing, shearing, breaking or the like, or by other means including dissolving, melting, evaporating or the like of the starter substrate.

As noted above, the product preform 132 should grow at a constant rate over the entire cross-sectional area in order for the freshly deposited material to maintain a flat surface during each cold spray deposition on the top layer 137 of material on axial deposition end 135. This flat surface is maintained using the spray patterns in which the amount of time spent by the cold spray nozzle 142 at any radial distance from the preform axis of rotation X-X is proportional to the radial distance from the nozzle 142 (taken as the radial center along axis N-N (FIGS. 1 and 2) of the nozzle 142) to the preform axis of rotation X-X. In these spray patterns, the feed rate of powder/particles through the nozzle 142 is substantially constant and the speed of rotation of the starter substrate and attached product preform is substantially constant.

This above condition may be met by an infinite number of different spray methods. The following three spray patterns provide non-limiting examples of spray patterns which can meet the above conditions. However, it should be appreciated that the present invention should not be limited to these spray patterns, and that a variety of other spray patterns are possible. In each example, movement of the nozzle 142 can be controlled by a multi-axis robot arm.

Spray Method 1

Figure 3:
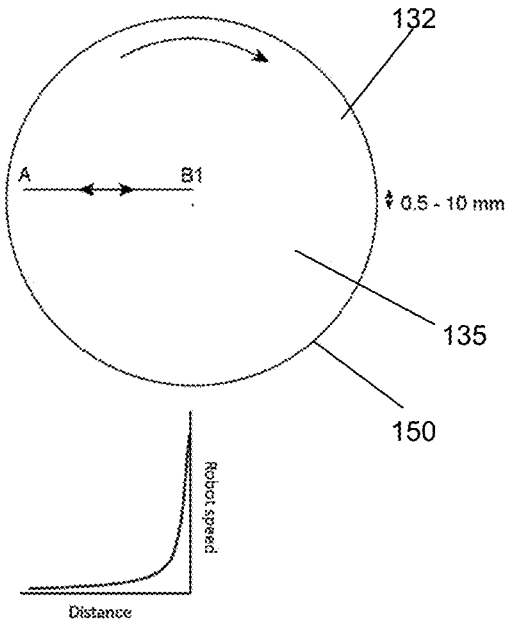
FIG. 3 is (A) a schematic of cold spray deposition pattern used to form a preform using two points according to an embodiment of the present invention; and (B) a plot of the instantaneous nozzle velocity when moving in that pattern.

As shown in FIG. 3(A), in spray method 1, the nozzle 142 is moved back-and-forth between two points, Point A and Point B1. Point A is at the edge of preform 132, and Point B1 is close to, or at the centre of the preform 132. The instantaneous velocity of the nozzle 142 moving across the end 135 is controlled to be inversely proportional to the distance from the end 143 of the nozzle 142 to the preform axis of rotation X-X. As shown in FIG. 3(B), the velocity of the nozzle 142 is therefore higher near Point B1, relative to the velocity of the nozzle near Point A.

Spray Method 2

Figure 4:
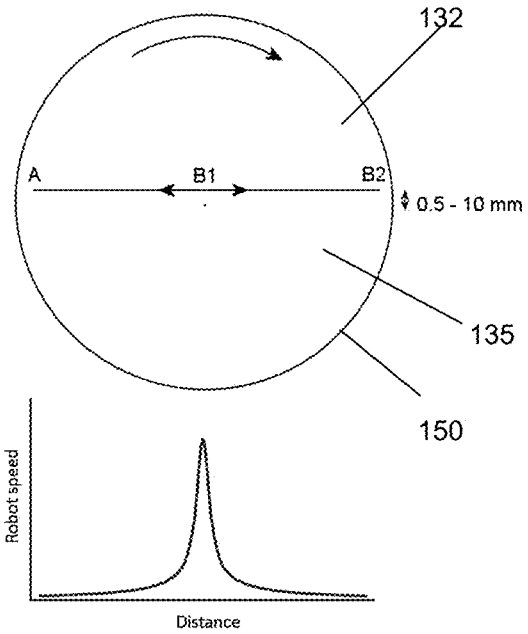
FIG. 4 is (A) a further schematic of cold spray deposition pattern used to form a preform using two points according to an embodiment of the present invention; and (B) a plot of the instantaneous nozzle velocity when moving in that pattern.

As shown in FIG. 4(A), in spray method 2, the nozzle 142 is moved back-and-forth between two points, Point A and Point B2. Both Point A and Point B2 are at the edge of the preform 132, usually on opposite sides. The instantaneous velocity of the nozzle 142 moving across the end 135 is controlled to be inversely proportional to the distance from the nozzle 142 to the preform axis of rotation X-X. As shown in FIG. 4(B), while moving from Point A towards Point B2 or from Point B2 towards A the velocity of the nozzle 142 initially increases, reaching a maximum at the point closest to the preform axis of rotation X-X (Point C, which is equidistant from Point A and Point B), and then decreases.

Spray Method 3

As shown in FIG. 5(A), in spray method 3, four points are used, Point A, B, C and D, and the nozzle 142 traces a rectangular path between them. Point A and B are on opposite edges of the preform 132 to Point C and D. There is a small distance, for example 0.5 to 10 mm, separating Point A from Point B, and an equally small distance separating Point C from Point D. In moving from Point A to Point B, and likewise from Point C to Point D, the instantaneous velocity of the nozzle 142 moving across the end 135 is controlled to be inversely proportional to the distance from the end 143 of the nozzle 142 to the preform axis of rotation X-X. A relatively fast nozzle movement can be used in moving from Point B to Point C and in moving from Point D to Point A.

It should be appreciated that strictly speaking, if the instantaneous nozzle velocity is inversely proportional to distance to the preform axis of rotation X-X, the nozzle 142 could only ever cross the preform axis of rotation X-X with an infinite velocity. In practice, it may be found acceptable to clip the maximum velocity so that the deposition rate at the centre of the preform 132 is not significantly greater than at greater diameters. In some embodiments, it may be preferable to prevent the nozzle 142 from crossing the preform axis of rotation X-X by offsetting the path of nozzle 142 movement by a small distance, for example 0.5 to 10 mm as shown in FIGS. 3(A), 4(A) and 5(A). Spray beams generally exhibit some degree of divergence which principally depends on the nozzle design. For example, a nozzle 142 with circular cross-section produces a circular spot pattern on the substrate surface. Accordingly, particles at the edge of the spray beam 144 should therefore 'fill in' the central part of the preform 132.

The nozzle 142 is normally aligned parallel or approximately parallel to the preform axis of rotation X-X. In some embodiments, it may also be necessary to change the angle of the nozzle 142 with respect to the preform axis of rotation X-X each time the nozzle 142 approaches the edge 150 (FIGS. 3 and 4) of the preform 132. Here, the cold spray nozzle 142 is turned so that it is angled inwards, towards the preform axis of rotation X-X (and the centre of the preform 132). This technique is used to control the growth of the edges 150 of the preform 132 so that it maintains a constant diameter.

Spray Method 4

Whilst not illustrated, a fourth spray method comprises movement of the nozzle 142 in a spiral pattern while the starter substrate 130 is rotating about the preform axis X-X. In this embodiment, the nozzle 142 can in some embodiments be moved by the robot at a substantially constant velocity.

Spray Method 5

Any of spray methods 1, 2 or 3 and other additional methods could be modified so that instead of the nozzle velocity being inversely proportional to distance to the preform axis of rotation X-X, the rotational speed of the starter substrate 130 and product preform 132 about the preform axis of rotation X-X is varied as a function of the nozzle 142 radial distance from the axis of rotation X-X. As can be appreciated, this also varies the instantaneous velocity between the nozzle end 148 and deposition surface 136. In such an embodiment, the speed of movement of the nozzle 142 as moved by a robot could be kept substantially constant.

EXAMPLES

The description of embodiments of the invention in the following examples is in the context of producing a round titanium alloy preform from titanium alloy particles. However, it will be appreciated that the invention enables production of preform of various metals and alloys thereof and the description should not be interpreted as limiting the embodiments to producing titanium alloy preform only.

Example 1

The apparatus 100 described and illustrated above was used to make a Ti-6Al-4V alloy preform. The cold spray system and conditions used were as follows:

Cold spray equipment: CGT Kinetiks 4000 system
Robot arm for controlling movement of cold spray gun: ABB IRB2600
Number of supersonic nozzles: one
Rotational mounting: a lathe with swivel head
Lathe speed 1000 rpm
Stand-off: 30 mm
Spray angle: Normal to the surface at all times
Gas: nitrogen
Gas stagnation temperature: 800° C.
Gas stagnation pressure: 3.5 MPa
Powder feed rate: 21.4 g/min
Robot traverse speed range: 7-163 mm/s The feedstock powder was Ti-6Al-4V manufactured by gas atomization. The starter substrate was an aluminium disc.

The Ti-6Al-4V preform was made using spray method 3 as described above. In producing the preform, the distance D between the end 144 of the nozzle 142 of the spray gun 140 and the top layer 137 of the end 135 was maintained by slowly moving the spray gun 140 backwards in the direction of arrow T (FIG. 2) during spraying away from the starter substrate by 0.3 mm for each repeat of the path shown in FIG. 5 so as to allow for growth of the deposit. Once spray deposition was ended, the starter preform was cut off the end of the produced round disk.

Figure 6:
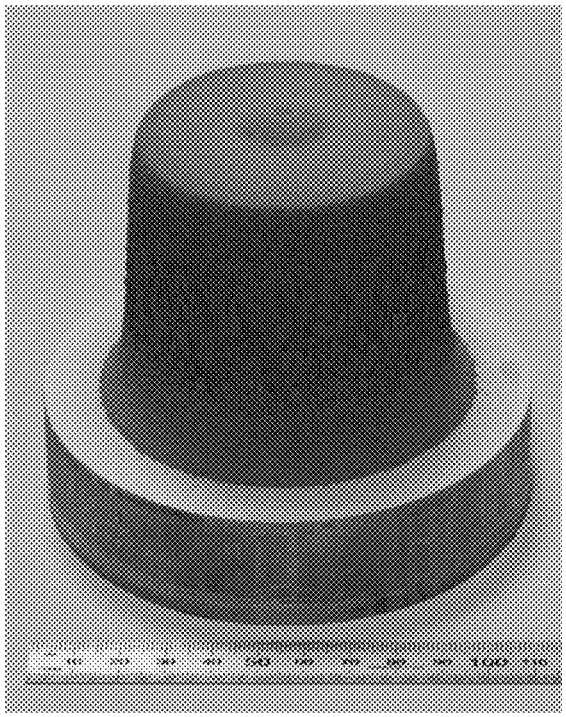
FIG. 6 provides a photograph of a Ti-6Al-4V preform attached to a starter substrate made using a spray method according to the present invention.

FIG. 6 shows a photograph of the Ti-6Al-4V preform and starter substrate after spraying with the aluminium starter substrate attached.

Example 2

The apparatus 100 described and illustrated above was used to make a Ti-6Al-4V alloy preform. The cold spray system and conditions used were as follows:

Cold spray equipment: Plasma Giken PCS-1000
Robot arm for controlling movement of cold spray gun: ABB IRB4600
Number of supersonic nozzles: one
Rotational mounting: a lathe with swivel head
Lathe speed 500 rpm
Stand-off: 20 mm
Spray angle: Normal to the surface at all times
Gas: nitrogen
Gas stagnation temperature: 900° C.
Gas stagnation pressure: 5.0 MPa
Powder feed rate: 41.3 g/min
Robot traverse speed range: 2-63 mm/s The feedstock powder was Ti-6Al-4V manufactured by gas atomization. The starter substrate was an aluminium disc.

Similar to Example 1, a Ti-6Al-4V preform was made using spray method 3 as described above. In producing the preform, the distance D between the end 144 of the nozzle 142 of the spray gun 140 and the top layer 137 of the end 135 was maintained by slowly moving the spray gun 140 backwards in the direction of arrow T (FIG. 2) during spraying away from the starter substrate by 1.0 mm for each repeat of the path shown in FIG. 5 so as to allow for growth of the deposit.

Figure 7:
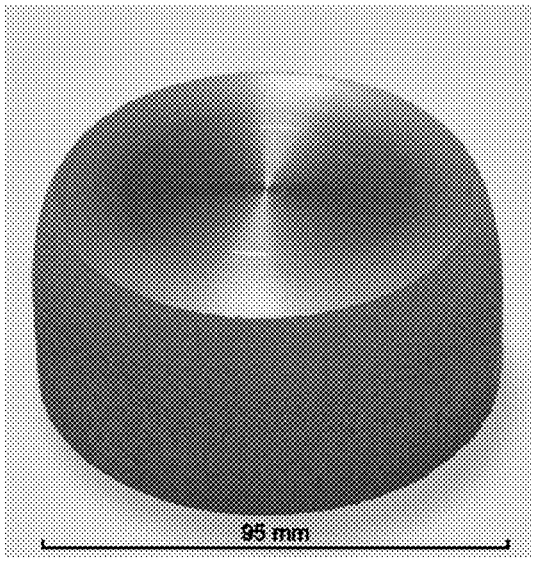
FIG. 7 provides a photograph of a titanium alloy Ti-6Al-4V preform made using a spray method according to the present invention. The starter substrate has been cut off from the bottom of the preform and the top surface machined.

Following cold spray the titanium deposit was removed from the aluminium starter disc by parting off in a lathe. The rough material on the surface was removed by machining leaving the shape shown in FIG. 7. From the machined face of this preform (FIG. 7) it is evident that a solid, metallic preform had been made.

Example 3

The apparatus described and illustrated above was used to make a further short pure titanium preform. The apparatus and spray conditions were the same as in Example 1 except for the following:

Lathe speed 500 rpm

Powder feed rate: 13.9 g/min

Robot traverse speed range: 2-80 mm/s

Figure 5:
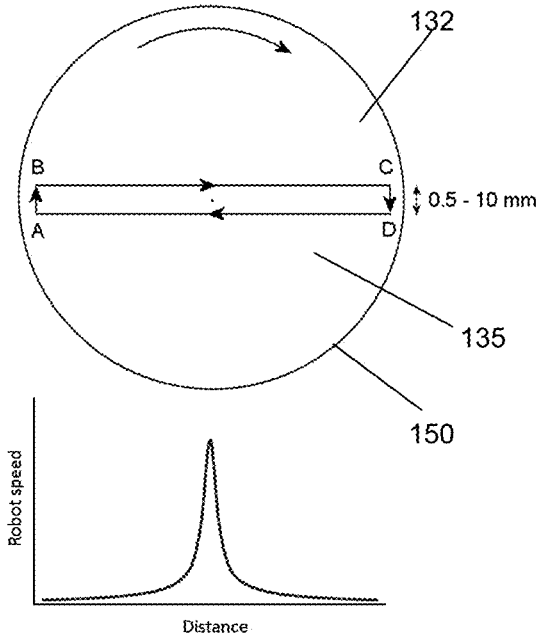
FIG. 5 is (A) a schematic of cold spray deposition pattern used to form a preform using four points according to an embodiment of the present invention; and (B) a plot of the instantaneous nozzle velocity when moving in that pattern.

The nozzle was moved away from the starter substrate by 0.7 mm for each repeat of the path shown in FIG. 5 so as to allow for growth of the deposit.

In this example, the feedstock powder was commercial purity titanium powder manufactured by the hydride-dehydride process. Again, a disc-shaped titanium preform was made having a similar configuration as the preforms shown in FIGS. 6 and 7.

Following cold spray the titanium deposit was removed from the aluminium starter by parting off in a lathe. The rough material on the surface was removed by machining, leaving a disc 73.9 mm in diameter and 8.6 mm thick. A slice was then cut from this disc and the slice then further cross-sectioned, cold mounted in epoxy resin and polished using standard metallographic techniques.

Figure 8:
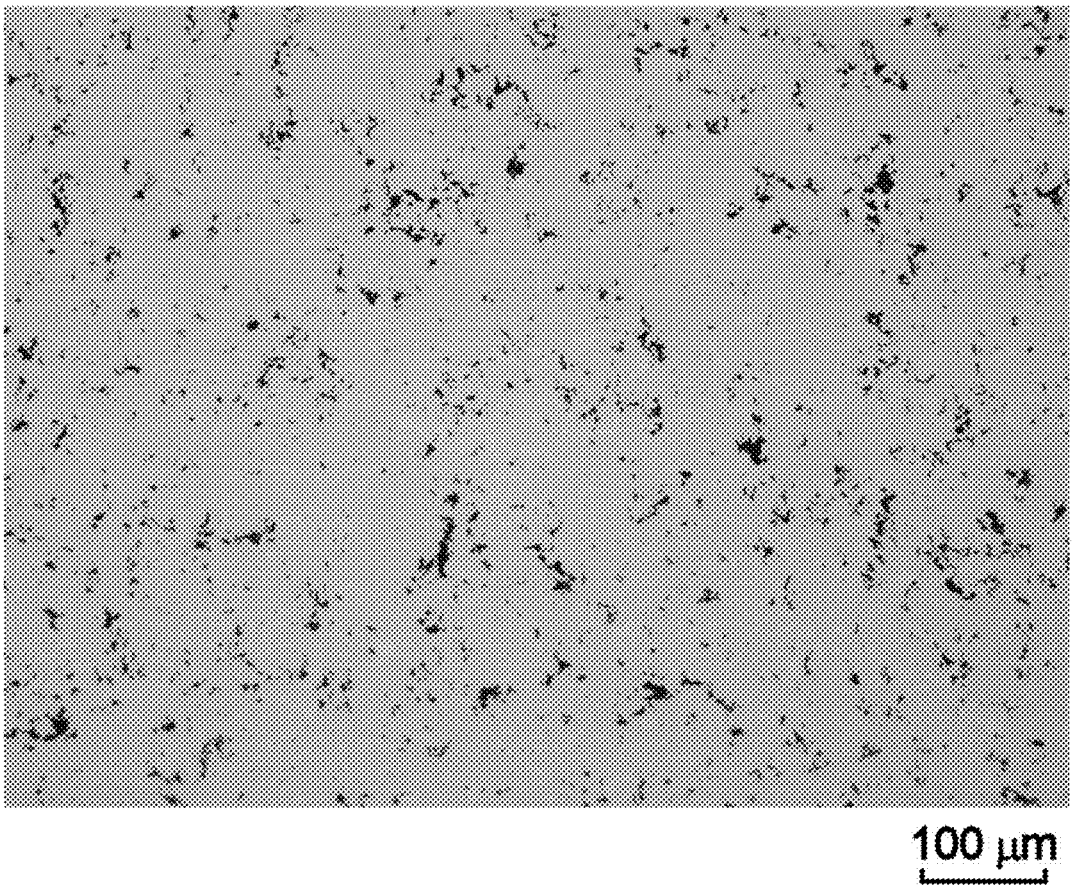
FIG. 8 is an optical micrograph of a pure titanium preform.

FIG. 8 shows the unetched microstructure from a photograph taken using an optical microscope. Pores could be seen between particles (black in FIG. 8). The concentration and distribution of pores was very uniform throughout the disc. The porosity was measured at a series of radial distances from the centre of the disc, by digital image analysis of micrographs such as FIG. 8. At each distance, measurements were taken from five micrographs in order to obtain a statistical average. The results, given in Table 1, show that the range of porosity was 4.6-7.0% throughout.

TABLE 1

Porosity Measurements for representative Ti preform sample

| Distance from axis of rotation (mm) | Measured porosity (%) |
|---|---|
| 0 | 5.3 ± 0.2 |
| 7 | 4.6 ± 0.2 |
| 12 | 4.6 ± 0.1 |
| 20 | 6.6 ± 0.3 |
| 27 | 5.9 ± 0.2 |
| 34 | 7.0 ± 0.1 |

Example 4

The apparatus 100 described and illustrated above was used to make a copper, disc-shaped preform. Pure, <200 mesh copper powder was used as the feedstock. The starter substrate was an aluminium disc. The cold spray system and conditions used were identical to Example 1 except for the following:

Lathe speed 500 rpm;

Gas stagnation temperature: 600° C.;

Gas stagnation pressure: 3.5 MPa;

Powder feed rate: 52.4 g/min;

Robot traverse speed range: 2-60 mm/s.

From weight measurements of the powder feeder directly before and after spray, it was determined that 885 g of powder was used. The weight added to the starter disc by the copper deposit was 823 g. From these two values, it can be concluded that the deposition efficiency was 93.1%.

Following cold spray, a round disc with diameter 82.3 mm and thickness 11.7 mm was machined. The weight of the disc was 551.43 g, giving a density of 8.86 g/cm$^3$, or 98.9% of the theoretical density of copper.

Whilst the examples and accompanying description only show preforms having a circular cross-section, it should be appreciated, that an asymmetrical round shape such as an oval shape could be produced by synchronising the rotational movement of the starter substrate and formed preform product with the lateral movement of the spray nozzle. Similarly, it should be appreciated that a void or hollow could also be introduced into the billet by introducing a no-deposit area or zone in the spray pattern of the cold spray applicator, where no material is deposited.

Similarly, whilst the examples and accompanying description only show preforms having a substantially constant cross-section, it should be appreciated that the preform can also be formed with variable or non-constant diameter such as a cone shapes, cone section, or shapes with a step or taper (large diameter to smaller diameter).

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. A process for producing a round preform by cold spray deposition, the process comprising:

providing a starter substrate about a preform axis of rotation, the starter substrate having at least one axial end having a substantially flat deposition surface;

rotating the starter substrate about the preform axis of rotation;

depositing material onto the deposition surface of the starter substrate using cold spray deposition to form a product deposition surface, the cold spray deposition process including a cold spray applicator through which the material is sprayed onto the deposition surface;

successively depositing material onto a respective top product deposition surface using cold spray deposition to form successive deposition layers of the material; and moving at least one of: the cold spray applicator; or the starter substrate and preform product, relative to the other in an axial direction along the preform axis of rotation to maintain a constant distance between the cold spray applicator and the top product deposition surface, thereby forming a round preform product about the preform axis of rotation of a selected length, wherein the cold spray applicator is moved in a plane perpendicular to the preform axis of rotation so as to deposit material as a flat surface on each respective deposition surface of the starter substrate or product deposition surface of the preform product, wherein the flat surface of deposit material is maintained through controlled movement of cold spray applicator in both the axial direction and in the plane perpendicular to the preform axis of rotation, wherein movement of the cold spray applicator is controlled so that the instantaneous velocity of the cold spray applicator relative to the deposit surface is inversely proportional to radial distance the cold spray applicator is to the preform axis of rotation, and wherein the deposited material comprises a metal or alloy thereof.

2. The process according to claim 1, wherein the controlled movement comprises a linear cyclical motion between at least two points.

3. The process according to claim 2, wherein the controlled movement comprises a linear cyclical motion between two points, point A and point B, selected from at least one of:

point A is at an edge of the preform product, and point B is close to, or at the centre of the preform product; or point A and point B are at an edge of the preform product.

4. The process according to claim 1, wherein the movement of the spray applicator is configured to have a radial offset from a parallel path running through the preform axis of rotation.

5. The process according to claim 1, wherein the controlled movement comprises a linear cyclical motion between four points, points A, B, C and D.

6. The process according to claim 5, wherein points A, B, C and D define the vertices of a regular polygon, and the controlled movement comprises linear movement traces the polygon shape between the respective points.

7. The process according to claim 1, wherein movement of the cold spray applicator in both the axial direction and in the plane perpendicular to the preform axis of rotation is controlled by a multi-axis robot arm.

8. The process according to claim 1, wherein the cold spray applicator includes a nozzle having an exit opening through which deposit material is sprayed, the nozzle directing the sprayed deposit material in a desired direction.

9. The process according to claim 8, wherein the nozzle is aligned to or parallel to the axis of preform rotation during movement.

10. The process according to claim 8, wherein the nozzle is directed to an angle, towards the centre of the axis of preform rotation when at or near an outer edge of the preform product.

11. The process according to claim 1, further comprising the step of:

removing the preform product from the starter substrate.

12. The process according to claim 1, wherein the starter substrate comprises at least one of:

a substrate with matching material properties; or a substrate made of dissimilar material.

13. The process according to claim 1, wherein the starter substrate comprises a starter preform.

14. The process according to claim 13, wherein the starter preform is made by a cold spray method.

15. The process according to claim 1, wherein the starter substrate has at least the same diameter as the preform product.

16. The process according claim 1, wherein the axial end surface of the starter substrate comprises a radially flat surface relative to the preform axis of rotation.

17. The process according to claim 1, wherein the starter substrate is held about the preform axis of rotation using a mounting arrangement which includes clamp or chuck.

18. The process according to claim 1, wherein the deposited material comprises a metal, an alloy thereof, or a metal composite, or a combination thereof.

* * * * *